US006916019B2

(12) United States Patent
Takahashi

(10) Patent No.: US 6,916,019 B2
(45) Date of Patent: Jul. 12, 2005

(54) END FENCE, SHEET FEEDING CASSETTE, SHEET FEEDING DEVICE, AND IMAGE FORMING APPARATUS INCLUDING THE END FENCE

(75) Inventor: Toshiaki Takahashi, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/692,794

(22) Filed: Oct. 27, 2003

(65) Prior Publication Data

US 2004/0135306 A1 Jul. 15, 2004

(30) Foreign Application Priority Data

Oct. 25, 2002 (JP) ..... 2002-310596

(51) Int. Cl.[7] ..... B65H 1/00
(52) U.S. Cl. ..... 271/145; 271/171
(58) Field of Search ..... 271/145, 171

(56) References Cited

U.S. PATENT DOCUMENTS 5,709,381 A 1/1998 Hourtash et al.
5,931,456 A * 8/1999 Laidlaw ..... 271/171
6,409,165 B1 6/2002 Yamaoka et al.
6,595,514 B2 7/2003 Takahashi
6,793,215 B2 * 9/2004 Salomon ..... 271/171
2002/0084576 A1 * 7/2002 Kim ..... 271/145

FOREIGN PATENT DOCUMENTS

JP 09-118439 5/1997
JP 2000-95356 4/2000

* cited by examiner

*Primary Examiner*—David H. Bollinger
(74) *Attorney, Agent, or Firm*—Oblon, Spivak, McClelland, Maier & Neustadt, P.C.

(57) ABSTRACT

An end fence for use in a sheet feeding cassette includes an end fence main body attached to the sheet feeding cassette and movable along a sheet feeding direction, a device that fixes the end fence main body at any desired position in the sheet feeding cassette, and a sheet pressing element that presses against trailing edges of the sheets loaded on a bottom plate of the sheet feeding cassette. The sheet pressing element is provided to the end fence main body and movable in the sheet feeding direction and protrudes from the end fence main body forward in the sheet feeding direction when the sheet pressing element moves in the sheet feeding direction. The end fence further includes a biasing device that biases the sheet pressing element forward in the sheet feeding direction, and a bias force switching device that switches between a biasing condition and a non-biasing condition.

20 Claims, 14 Drawing Sheets

END FENCE, SHEET FEEDING CASSETTE, SHEET FEEDING DEVICE, AND IMAGE FORMING APPARATUS INCLUDING THE END FENCE

CROSS-REFERENCE TO RELATED APPLICATIONS

The present application claims priority to Japanese Patent Application No. 2002-310596 filed in the Japanese Patent Office on Oct. 25, 2002, the disclosure of which is incorporated herein by reference.

BACKGROUND OF THE INVENTION

1. Field of the Invention

The present invention relates to an end fence, a sheet feeding cassette, a sheet feeding device, and an image forming apparatus including the end fence.

2. Background of the Art

For example, as illustrated in FIG. 1A, a background sheet feeding cassette for use in an image forming apparatus, such as, a copying machine, a printer, a facsimile machine, and other similar image forming apparatuses, that includes a sheet feeding cassette main body 101 (hereinafter referred to as a "cassette main body 101"), a bottom plate 103, an end fence 104, and a sheet leading edge regulating part 105. The bottom plate 103 is rotatable up and down about a supporting point 102. The end fence 104 is slidable and can be fixed at any desired position. The sheet leading edge regulating part 105 aligns leading edges of sheets (S) as recording media accommodated in the cassette main body 101 (i.e., loaded on the bottom plate 103) in a sheet-feeding direction (hereinafter referred to as a "sheet feeding direction"). The bottom plate 103 is biased by a biasing device (not shown), such as, a plate spring, such that the leading edge side in the sheet feeding direction of the sheets (S) loaded on the bottom plate 103 rotates upward. The end fence 104 is slidable in the sheet feeding direction.

When loading the sheets (S) into the cassette main body 101, the leading edges of the sheets (S) in the sheet feeding direction are brought into contact with the sheet leading edge regulating part 105. Subsequently, the end fence 104 is slid and brought into contact with the trailing edges of the sheets (S) in the sheet feeding direction. Thus, the sheets (S) are aligned along the sheet feeding direction in the cassette main body 101 by the sheet leading edge regulating part 105 and the end fence 104.

As the sheets (S) are fed by a sheet feeding roller 106 one by one, and as the number of sheets (S) decreases in the cassette main body 101, the bottom plate 103 rotates upward about the supporting point 102. With such an upward rotation of the bottom plate 103, the leading edge side of the sheets (S) loaded on the bottom plate 103 is raised, and an uppermost sheet of the stack of sheets (S) is kept in a position of contacting an outer peripheral surface of the sheet feeding roller 106.

However, as the bottom plate 103 rotates upward, a distance between the leading edges of the sheets (S) loaded on the bottom plate 103 and the sheet leading edge regulating part 105 gradually increases. As a result, as illustrated in FIG. 1B, the uppermost sheet of the sheets (S) fails to adequately contact the sheet feeding roller 6, thereby causing a sheet feeding failure.

To prevent a sheet feeding failure, as illustrated in FIGS. 2A through 2C, the use of an end fence 108, including a sheet pressing element 107 that presses the trailing edges in a sheet feeding direction of sheets (S) accommodated in the cassette main body 101 toward the sheet leading edge regulating part 105, has been proposed, for example, in published Japanese patent application No. 2000-95356.

The sheet pressing element 107 is configured to rotate about a supporting point 109 along the sheet feeding direction. Further, the sheet pressing element 107 is biased toward the sheet leading edge regulating part 105 by a biasing device (not shown) such as a spring. When the sheet pressing element 107 does not contact the sheets (S) and when the number of the sheets (S) loaded on the bottom plate 103 decreases, the sheet pressing element 107 protrudes forward in the sheet feeding direction as illustrated in FIGS. 2A and 2C.

When loading the sheets (S) into the cassette main body 101, including the end fence 108, the leading edges of the sheets (S) in the sheet feeding direction are brought into contact with the sheet leading edge regulating part 105. Subsequently, the sheet pressing element 107 is brought into contact with the trailing edges of the sheets (S) while sliding the end fence 108 forward in the sheet feeding direction. The end fence 108 is fixed at this position. At this time, as illustrated in FIG. 2B, the sheet pressing element 107 is rotated to a retracted position (i.e., a position where the sheet pressing element 107 does not protrude forward in the sheet feeding direction) against a bias force of the biasing device, thereby strongly abutting the sheet pressing element 107 against the trailing edges of the sheets (S).

As the sheets (S) are fed by the sheet feeding roller 106 one by one and the number of sheets (S) decreases in the cassette main body 101, the bottom plate 103 rotates upward about the supporting point 102 as illustrated in FIG. 2C. With such an upward rotation of the bottom plate 103, the leading edge of the sheets (S) loaded on the bottom plate 103 is raised. At the same time, the sheet pressing element 107, abutting against the trailing edges of the sheets (S), presses the sheets (S) forward in the sheet feeding direction by the bias force applied by the biasing device. Thus, even when the bottom plate 103 rotates upward about the supporting point 102 as the number of sheets (S) loaded on the bottom plate 103 decreases, a distance between the leading edges of the sheets (S) in the sheet feeding direction and the sheet leading edge regulating part 105 is kept constant, and a contact between the uppermost sheet of the sheets (S) and the sheet feeding roller 106 is adequately maintained. As a result, the sheets (S) can be stably fed by the sheet feeding roller 106.

However, the end fence 108 may be fixed at an inadequate position by an unexperienced operator or by loading the sheets (S) carelessly in the cassette. Specifically, as illustrated in FIG. 3A, when the sheet pressing element 107 is brought into contact with the trailing edges of the sheets (S) while sliding the end fence 108 forward in the sheet feeding direction, the end fence 108 stops sliding and is fixed at a position where the sheet pressing element 107 is rotated forward and brought into contact with the trailing edges of the sheets (S) by the biasing device.

In this condition, when the bottom plate 103 is rotated upward as the number of the sheets (S) loaded on the bottom plate 103 decreases, the sheet pressing element 107, which has been rotated to a protruded position forward in the sheet feeding direction, cannot press the sheets (S) loaded on the bottom plate 103 forward toward the sheet leading edge regulating part 105. As in the case of the background sheet feeding cassette of FIG. 1B, a distance between the leading edges of the sheets (S) loaded on the bottom plate 103 and the sheet leading edge regulating part 105 gradually increases as the bottom plate 103 is rotated upward. As a result, as illustrated in FIG. 3B, the uppermost sheets inadequately contact the sheet feeding roller 6, thereby causing a sheet feeding failure.

To avoid an occurrence of a sheet feeding failure, for example, a mark which indicates a fixing position of the end fence 108 corresponding to a size of the sheet (S) may be attached to the cassette main body 101. However, such a mark is not useful when the sheet (S) of an irregular size is used. Moreover, even if the sheet (S) of a standard size is used, the size of the sheet (S) may vary among the different sheet manufacturers. Thus, even if the end fence 108 is fixed at the marked position corresponding to the size of the sheet (S), a sheet feeding failure may still result.

Thus, it is desirable to provide an end fence that enables sheets to be fed stably even when a bottom plate loaded with a stack of sheets is rotated upward in a sheet feeding cassette, a sheet feeding device, or an image forming apparatus comprising a sheet feeding cassette or device having such an end fence.

SUMMARY OF THE INVENTION

According to one aspect of the present invention, an end fence for use in a sheet feeding cassette, including a bottom plate which is rotatable up and down while being biased upward, includes an end fence main body that is attached to the sheet feeding cassette and movable in a direction along a feeding direction of sheets loaded on the bottom plate, a fixing device configured to fix the end fence main body at any desired position in the sheet feeding cassette, and a sheet pressing element configured to press trailing edges of the sheets loaded on the bottom plate in a sheet feeding direction. The sheet pressing element is provided to the end fence main body and movable in the sheet feeding direction, and protrudes from the end fence main body forward in the sheet feeding direction when the sheet pressing element moves in the sheet feeding direction. The end fence further includes a biasing device configured to bias the sheet pressing element in a direction in which the sheet pressing element moves forward in the sheet feeding direction, and a bias force switching device configured to switch between a biasing condition in which a bias force is exerted on the sheet pressing element and a non-biasing condition in which a bias force is not exerted on the sheet pressing element.

According to another aspect of the present invention, a sheet feeding cassette includes a cassette main body configured to accommodate sheets, a bottom plate that is provided at a bottom surface part of the cassette main body and is rotatable up and down while being biased upward, and the above-described end fence.

According to another aspect of the present invention, a sheet feeding device includes the above-described sheet feeding cassette, and a sheet feeding member configured to feed the sheets accommodated in the cassette main body one by one.

According to yet another aspect of the present invention, an image forming apparatus includes the above-described sheet feeding device, and an image forming device configured to form an image on the sheet fed by the sheet feeding device.

BRIEF DESCRIPTION OF THE DRAWINGS

A more complete appreciation of the present invention, and many of the attendant advantages thereof, will be readily obtained as the same becomes better understood by reference to the following detailed description when considered in connection with the accompanying drawings, wherein.

DETAILED DESCRIPTION OF THE PREFERRED EMBODIMENTS

Figure 1A:
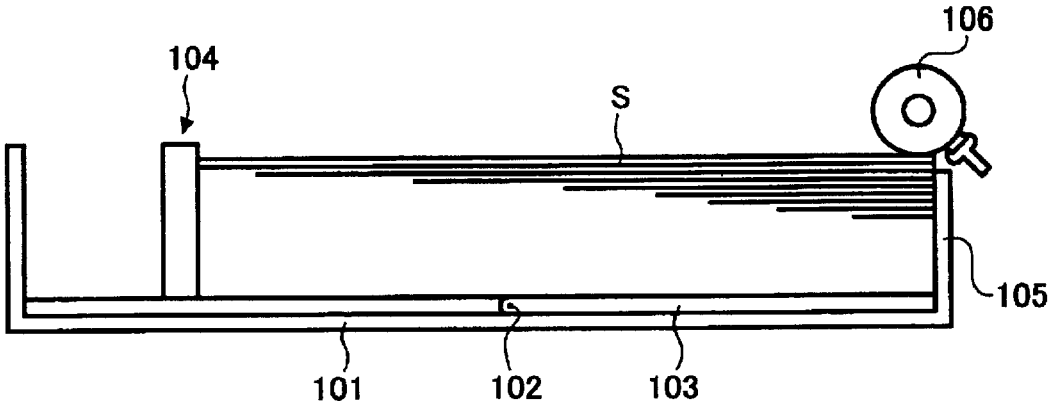
FIG. 1A BACKGROUND ART
FIG. 1A is a side view of a sheet feeding cassette according to a background art.
Figure 1B:
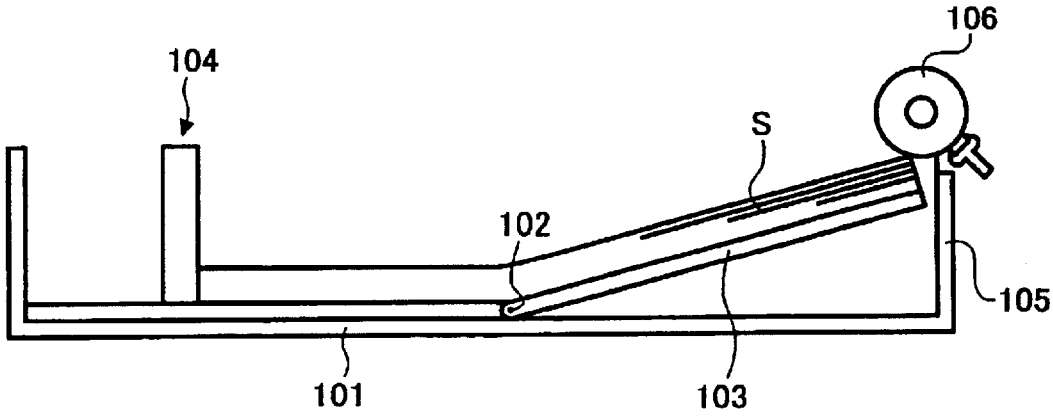
FIG. 1B BACKGROUND ART
FIG. 1B is a side view of the sheet feeding cassette of FIG. 1A in which the uppermost sheet inadequately contacts a sheet feeding roller.
Figure 2A:
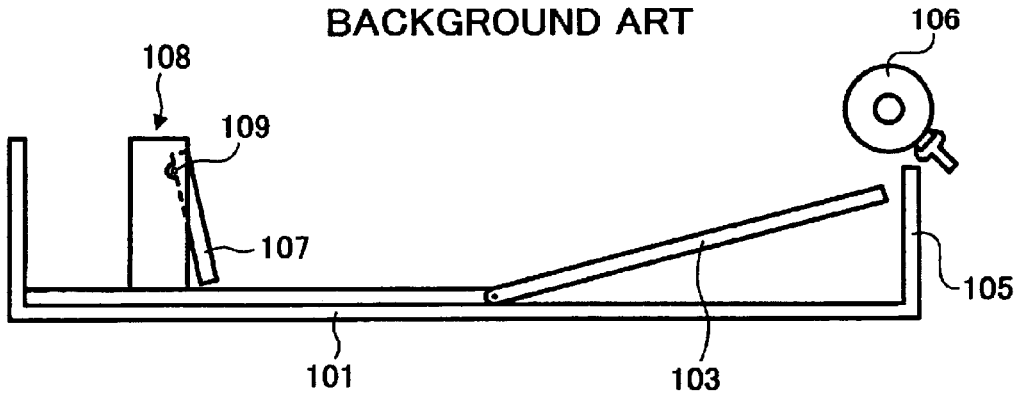
FIG. 2A BACKGROUND ART
FIG. 2A is a side view of a sheet feeding cassette according to another background art in which a sheet pressing element protrudes forward in a sheet feeding direction.
Figure 2B:
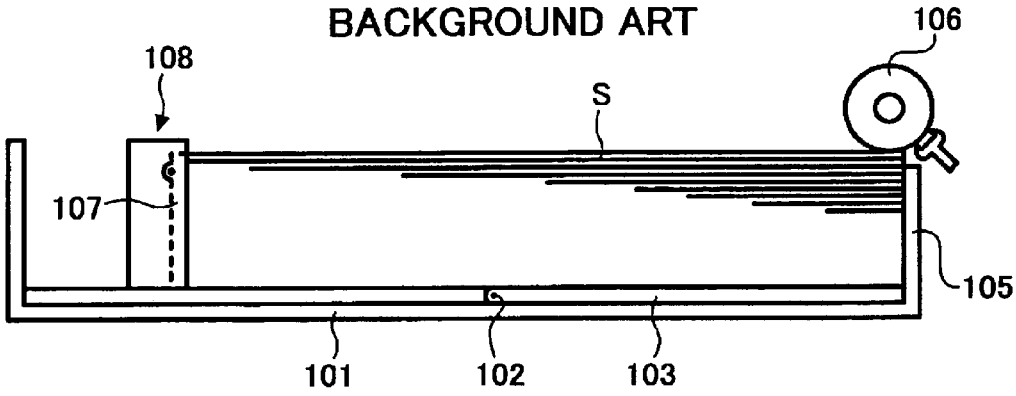
FIG. 2B BACKGROUND ART
FIG. 2B is a side view of the sheet feeding cassette of FIG. 2A in which the sheet pressing element is rotated to a retracted position.
Figure 2C:
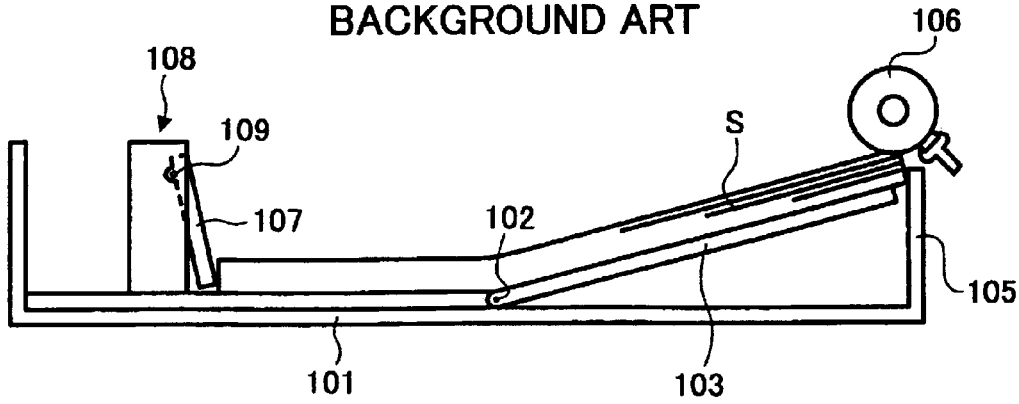
FIG. 2C BACKGROUND ART
FIG. 2C is a side view of the sheet feeding cassette of FIG. 2A in which the sheet pressing element abuts against the trailing edges of the sheets, pressing them forward in the sheet feeding direction.
Figure 3A:
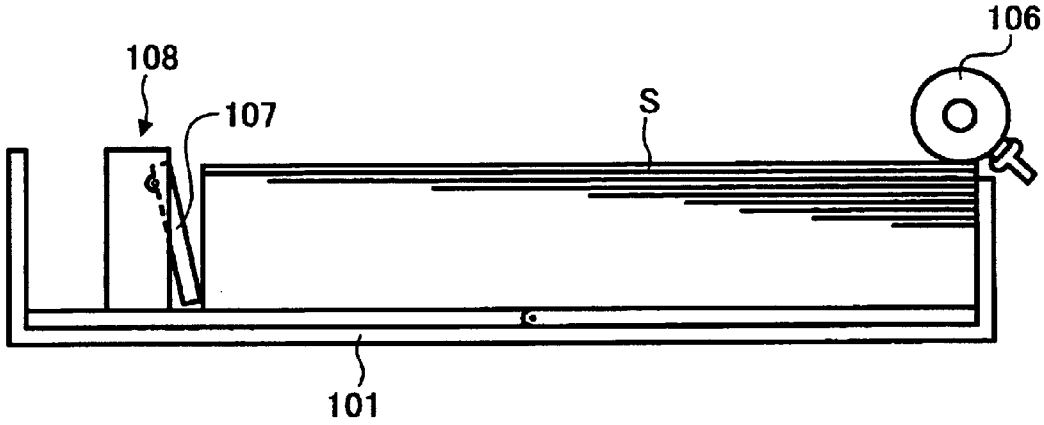
FIG. 3A BACKGROUND ART
FIG. 3A is a side view of the sheet feeding cassette of FIG. 2A in which an end fence stops sliding at a position where the sheet pressing element is rotated forward and brought into contact with the trailing edges of the sheets.
Figure 3B:
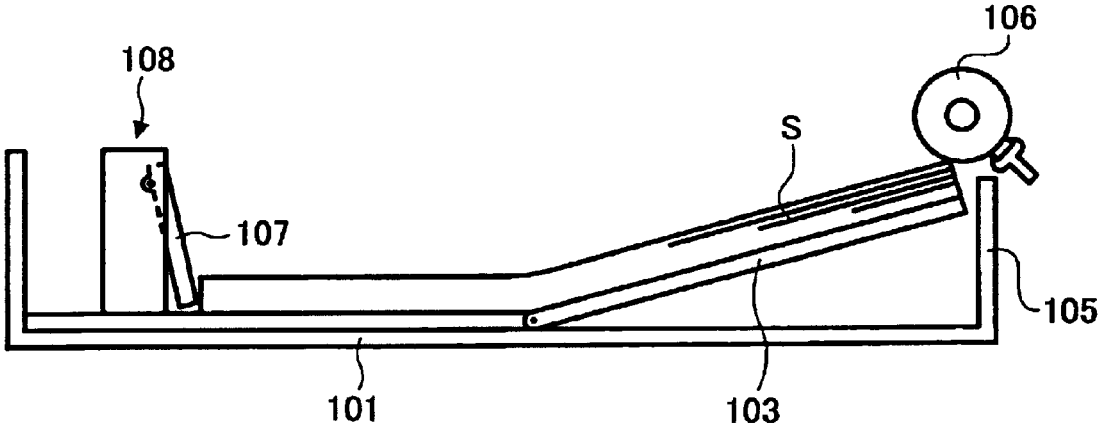
FIG. 3B BACKGROUND ART
FIG. 3B is a side view of the sheet feeding cassette of FIG. 3A in which the uppermost sheet inadequately contacts a sheet feeding roller.

Preferred embodiments of the present invention are described in detail referring to the drawings, wherein like reference numerals designate identical or corresponding parts throughout the several views.

Figure 4:
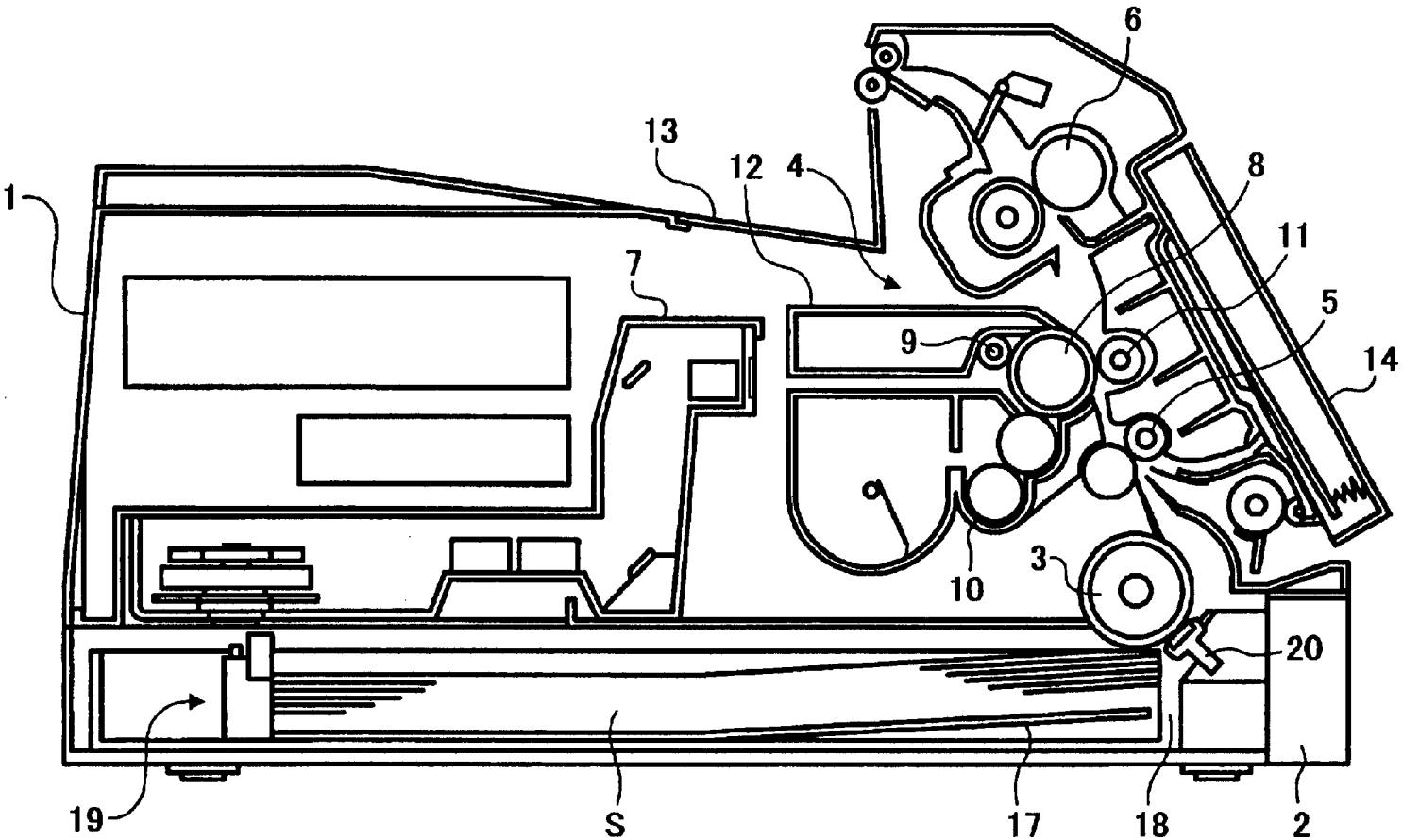
FIG. 4 is a schematic view of a printer as an example of an image forming apparatus according to an embodiment of the present invention.

FIG. 4 is a schematic view of a printer as an example of an image forming apparatus according to an embodiment of the present invention. Provided in a main body case 1 of the printer are a sheet feeding cassette 2, a sheet feeding roller 3, an image forming device 4, a pair of registration rollers 5, a fixing device 6, etc. Specifically, the sheet feeding cassette 2 can be pulled out from the main body case 1. The sheet feeding roller 3, functioning as a sheet feeding member, feeds sheet-shaped recording media (S) (or simply referred to as "sheets" (S)) accommodated in the sheet feeding cassette 2 one by one. The image forming device 4 forms images on the sheets (S) fed by the sheet feeding roller 3. The pair of registration rollers 5 feed the sheets (S) toward the image forming device 4 at an appropriate timing. The fixing device 6 fixes an image (i.e., a toner image) formed on the sheet (S).

The image forming device 4 includes a photoreceptor 8, a charging device 9, a developing device 10, a transfer device 11, and a cleaning device 12. Specifically, a light writing device 7 irradiates a surface of the photoreceptor 8 with a light, thereby forming an electrostatic latent image on the photoreceptor 8. The charging device 9 uniformly charges the unexposed surface of the photoreceptor 8. The developing device 10 develops the electrostatic latent image on the photoreceptor 8 with toner and forms a toner image. The transfer device 11 transfers the toner image formed on the photoreceptor 8 onto the sheet (S). After the toner image formed on the photoreceptor 8 is transferred onto the sheet (S), the cleaning device 12 removes residual toner remaining on the photoreceptor 8.

At a top surface of the main body case 1, for example, a sheet discharging section 13 is formed. The sheet (S), having a fixed toner image, is discharged and stacked on the sheet discharging section 13. At a side surface of the main body case 1, an openable and closable manual sheet feeding tray 14 is provided to manually supply the sheet (S).

Figure 5A:
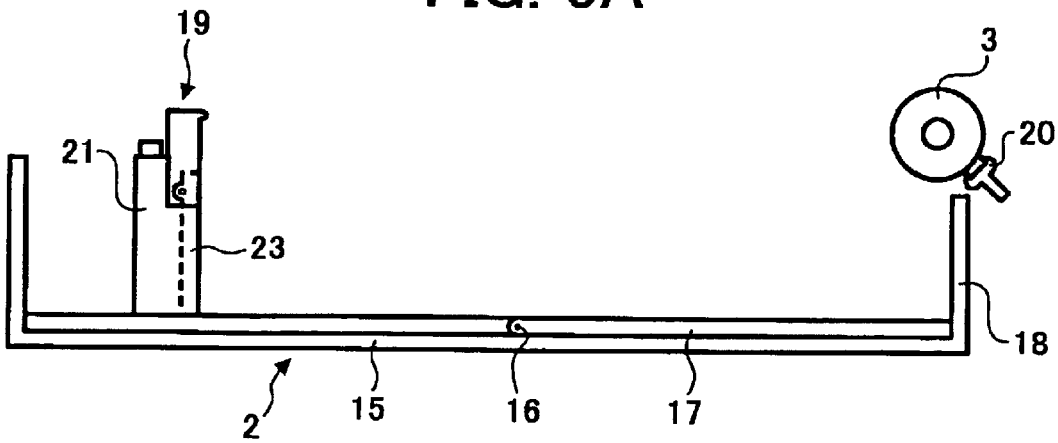
FIG. 5A is a side view of a sheet feeding device according to an embodiment of the present invention in which a sheet pressing element is retracted into an end fence main body.

As illustrated in FIG. 5A, the sheet feeding cassette 2 includes a box-shaped cassette main body 15, a bottom plate 17, a sheet leading edge regulating part 18, an end fence 19, and a friction/separation pad 20. Specifically, an upper part of the box-shaped cassette main body 15 is uncovered to accommodate the sheets (S). The bottom plate 17 is disposed at a bottom surface of the cassette main body 15 such that the bottom plate 17 is rotatable up and down about a supporting point 16. The sheet leading edge regulating part 18 aligns the leading edges of the sheets (S) in the cassette main body is in a sheet feeding direction. The end fence 19 is slidable along the sheet feeding direction and aligns the trailing edges of the sheets (S) in the cassette main body 15 in the sheet feeding direction. The friction/separation pad 20 abuts an outer peripheral surface of the sheet feeding roller 3, separates the sheet from the stack of the sheets (S), and feeds the sheets (S) one by one in cooperation with the sheet feeding roller 3. The bottom plate 17 is biased upward by a press-up type or pull-up type spring (not shown) such that the bottom plate 17 is rotated in a direction in which a leading edge side of the sheets (S) in the sheet feeding direction loaded on the bottom plate 17 is brought into contact with the outer peripheral surface of the sheet feeding roller 3.

The end fence 19 includes an end fence main body 21, a fixing device 22, a sheet pressing element 23, a plate spring 24 functioning as a biasing device, a bias force switching device 25, and a link device 26. The details of these elements are described below.

Figure 6A:
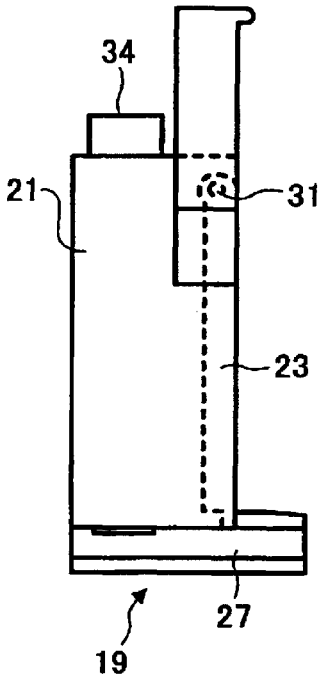
FIG. 6A is a side view of an end fence according to the embodiment of the present invention in which a bias force switching device is switched to a non-biasing condition.
Figure 6B:
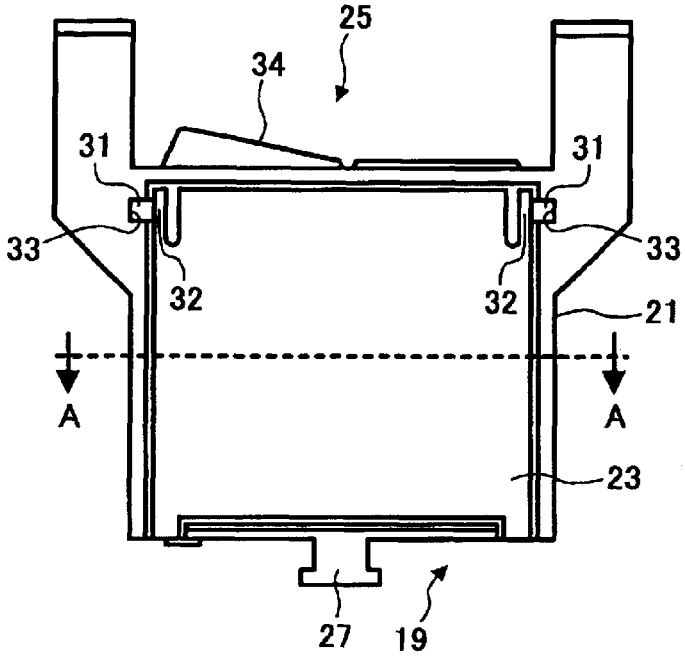
FIG. 6B is a front view of the end fence of FIG. 6A.

The end fence main body 21 is configured to slide along the sheet feeding direction. A sliding convex portion 27 is formed at a bottom surface portion of the end fence main body 21 as illustrated in FIGS. 6A and 6B. The sliding convex portion 27 is slidably engaged with a guide groove 28 formed at a bottom surface portion 15*a* (illustrated in FIGS. 10A and 10B) of the cassette main body 15. The guide groove 28 is formed substantially linearly along a feeding direction of the sheets (S) accommodated in the sheet feeding cassette 2.

Figure 7A:
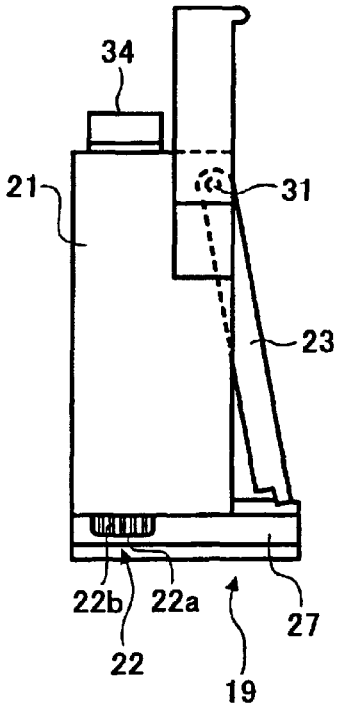
FIG. 7A is a side view of the end fence in which the bias force switching device is switched to a biasing condition.
Figure 7B:
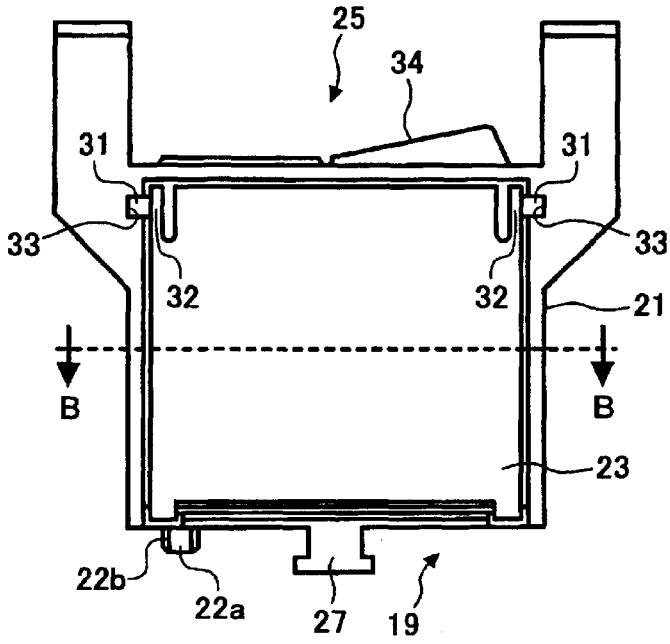
FIG. 7B is a front view of the end fence of FIG. 7A.
Figure 10A:
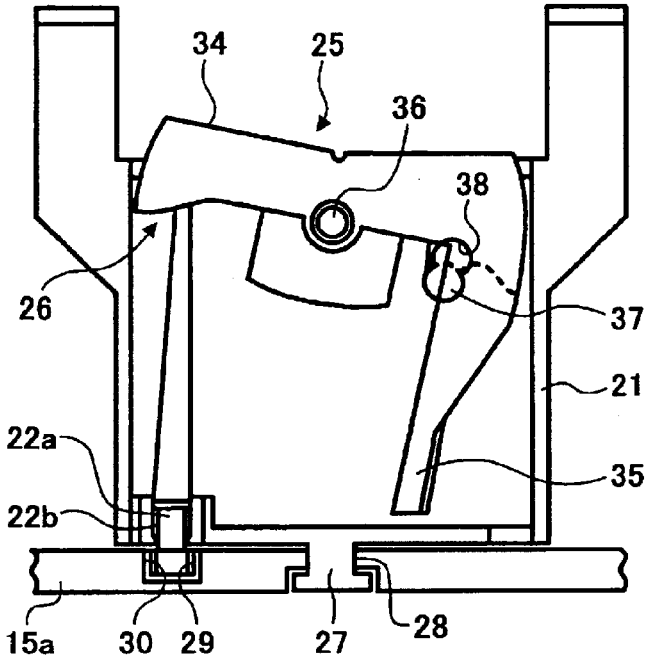
FIG. 10A is a front view of the end fence in which the bias force switching device is switched to the non-biasing position.
Figure 10B:
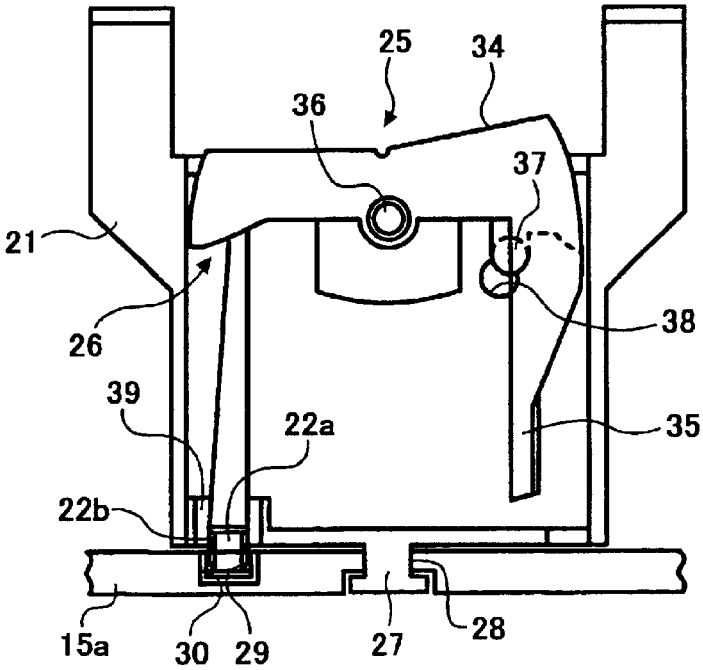
FIG. 10B is a front view of the end fence in which the bias force switching device is switched to the biasing position.

The fixing device 22 fixes the end fence main body 21 at any desired position. As illustrated in FIGS. 7A and 7B, the fixing device 22 includes a bar-shaped sliding element 22*a*, and a meshing teeth portion 22*b* formed at an outer peripheral surface of a lower end portion of the sliding element 22*a*. The sliding element 22*a* slides up and down and is configured to protrude and retract from/to a bottom surface portion of the end fence main body 21. As illustrated in FIGS. 10A and 10B, at a bottom surface portion 15*a* of the cassette main body 15, a linear-shaped fixing groove 29 is formed such that the fixing groove 29 parallels the guide groove 28 and opposes the sliding element 22*a*. Further, a rack-shaped meshing teeth portion 30 is formed at an edge portion of the fixing groove 29 to mesh with the meshing teeth portion 22*b*. The end fence main body 21 is fixed by sliding the sliding element 22*a* to a position where the sliding element 22*a* protrudes from the bottom surface portion of the end fence main body 21, and by meshing the meshing teeth portion 22*b* with the meshing teeth portion 30.

As illustrated in FIGS. 6A, 6B, 7A, and 7B, the sheet pressing element 23 is formed from a plate-shaped member, and is attached to the end fence main body 21 such that the sheet pressing element 23 rotates about a support shaft 31 along a feeding direction of the sheets (S) in the cassette main body 15. When the sheet pressing element 23 rotates forward in the sheet feeding direction (i.e., toward the sheet leading edge regulating part 18), the outer side surface of the sheet pressing element 23 facing the sheet leading edge regulating part 18 protrudes from the end fence main body 21 toward the sheet feeding direction. The support shaft 31 is integrally formed with the sheet pressing element 23 via a flexible portion 32, and is engaged with a hole 33 formed in the end fence main body 21. When the sheet pressing element 23 is attached to the end fence main body 21, the support shaft 31 is first positioned opposite to the hole 33 such that the flexible portion 32 is flexed inward. Subsequently, the flexible portion 32 is released, and the support shaft 31 is elastically engaged with the hole 33.

Figure 6C:
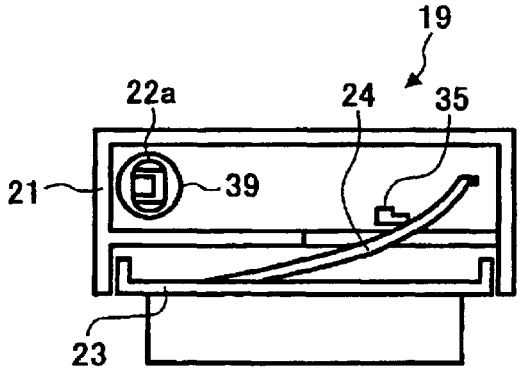
FIG. 6C is a cross-sectional view taken along line A—A of FIG. 6B.
Figure 7C:
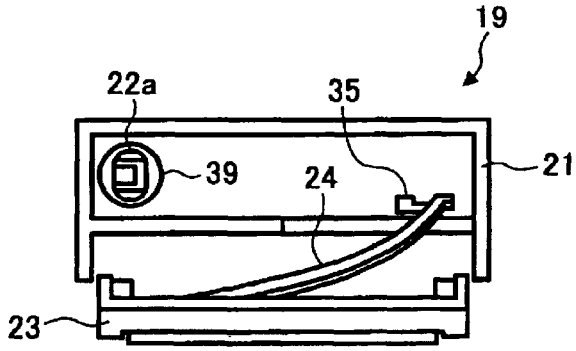
FIG. 7C is a cross-sectional view taken along line B—B of FIG. 7B.
Figure 8:
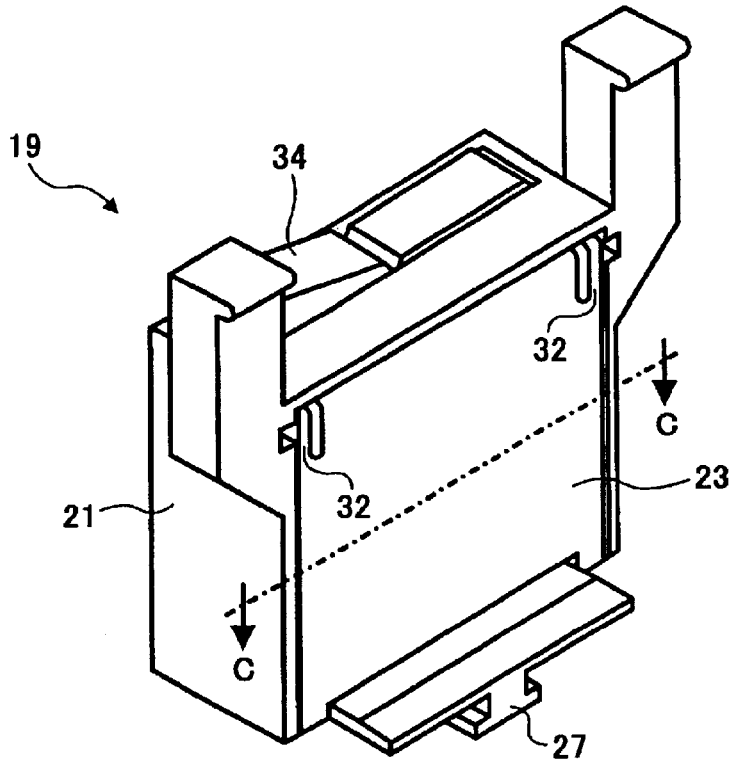
FIG. 8 is a perspective view of the end fence according to an embodiment of the present invention.
Figure 9:
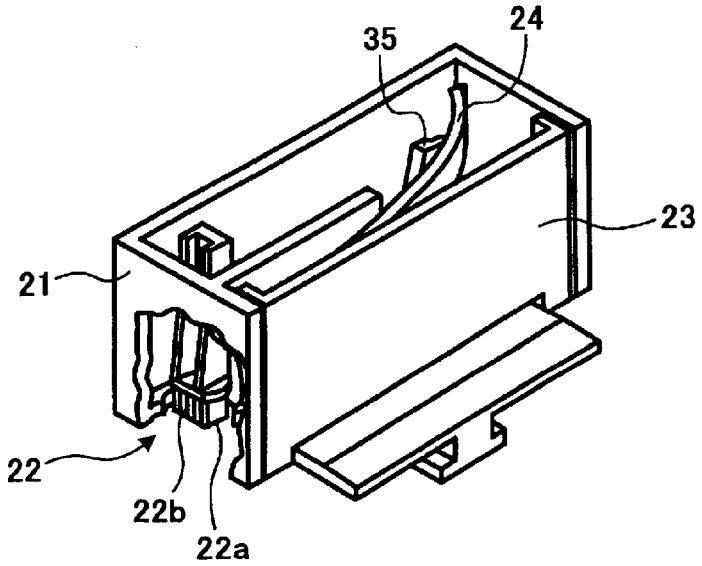
FIG. 9 is a cross-sectional perspective view taken along line C—C of FIG. 8.

The plate spring 24 functioning as a biasing device is integrally formed with the inner side surface of the sheet pressing element 23 opposite from its outer side surface facing the sheet leading edge regulating part 18. As illustrated in FIGS. 6C, 7C, and 9, one end of the plate spring 24 is fixed onto the sheet pressing element 23, and the other end is arcuately bent in a direction away from the sheet pressing element 23. The plate spring 24 exerts a force on the sheet pressing element 23 such that the sheet pressing element 23 is biased forward in the sheet feeding direction.

The bias force switching device 25 is configured to switch between a biasing condition and a non-biasing condition. In the biasing condition, the bias force of the plate spring 24 is exerted on the sheet pressing element 23 as illustrated in FIGS. 7A through 7C. In the non-biasing condition, the bias force of the plate spring 24 is not exerted on the sheet pressing element 23 as illustrated in FIGS. 6A through 6C. The bias force switching device 25 includes a switch operation unit 34 for switching between the biasing condition and the non-biasing condition, and a movable element 35 configured to move the plate spring 24 as the switch operation unit 34 is moved from a biasing position (illustrated in FIG. 7C), where the bias force of the plate spring 24 is exerted on the sheet pressing element 23, to a non-biasing position (illustrated in FIG. 6C), where the bias force of the plate spring 24 is not exerted on the sheet pressing element 23. The movable element 35 is formed from a bar-shaped member, and is integrally formed with the switch operation unit 34 at one end side of the switch operation unit 34 across a support shaft 36 as illustrated in FIGS. 10A and 10B.

Figure 5B:
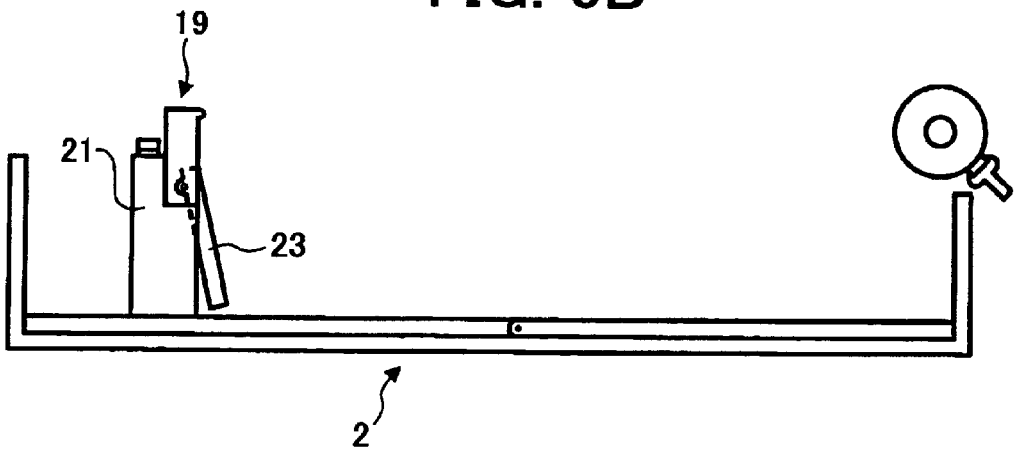
FIG. 5B is a side view of the sheet feeding device of FIG. 5A in which the sheet pressing element is protruded forward in the sheet feeding direction.

When the movable element 35 moves to the biasing position by the switch operation unit 34, the movable element 35 contacts the leading edge of the plate spring 24 as illustrated in FIG. 7C, causing the plate spring 24 to be flexed toward the sheet pressing element 23. With such a flexion of the plate spring 24, the bias force of the plate spring 24 is exerted on the sheet pressing element 23, thereby rotating the sheet pressing element 23 forward in the sheet feeding direction as illustrated in FIGS. 5B and 7A.

In the non-biasing position, the movable element 35 contacts the fixed side of the plate spring 24 as illustrated in FIG. 6C, and the flexion of the plate spring 24 is cancelled. As a result, the bias force of the plate spring 24 is not exerted on the sheet pressing element 23, thereby retracting the sheet pressing element 23 into the end fence main body 21 as illustrated in FIGS. 5A and 6A.

The switch operation unit 34, movable to the biasing position and the non-biasing position on the support shaft 36, is configured to be fixedly held at both the biasing position and the non-biasing position. As illustrated in FIGS. 10A and 10B, the switch operation unit 34 is fixed at the biasing and non-biasing positions by engaging a pin 37, integrally formed with the switch operation unit 34, with a hole 38 in the shape of a snowman formed in the end fence main body 21.

At the other end side of the switch operation unit 34, across the support shaft 36, the sliding element 22*a* of the fixing device 22 is integrally formed with the switch operation unit 34 as illustrated in FIGS. 10A and 10B. A flexible connecting part between the switch operation unit 34 and the sliding element 22*a* is formed by reducing the thickness of the upper end portion of the sliding element 22*a*. The sliding element 22*a* is configured to slide up and down by movement of the switch operation unit 34 around the support shaft 36. A guide hole 39 (illustrated in FIGS. 6C, 7C, and 10B) is formed in the end fence main body 21 to guide the up-and-down motion of the lower end portion of the sliding element 22*a*.

When the bias force switching device 25 is switched to the biasing position, the sliding element 22*a* protrudes downward from the end fence main body 21 as illustrated in FIGS. 7A and 7B. The end fence main body 21 is fixed by engaging the meshing teeth portion 22*b* of the sliding element 22*a* with the meshing teeth portion 30 of the fixing groove 29 as illustrated in FIG. 10B.

When the bias force switching device 25 is switched to the non-biasing position, the sliding element 22*a* slides upward from the lower end surface of the end fence main body 21 (see FIGS. 6A and 6B), thereby disengaging the meshing teeth portion 22*b* of the sliding element 22*a* from the meshing teeth portion 30 of the fixing groove 29 as illustrated in FIG. 10A. As a result, the end fence main body 21 is released, becoming slidable along the sheet feeding direction.

The link device 26 is constructed such that the flexible sliding element 22*a* is integrally formed with the switch operation unit 34 at its end side across the support shaft 36. With such a link device 26, the switching to the biasing condition is substantially simultaneously linked with the fixing of the end fence main body 21 by the fixing device 22. Likewise, the switching to the non-biasing condition by the switching device 25 is linked with the releasing of the end fence main body 21 by the fixing device 22 in a similar fashion. Thus, the operability of the end fence 19 is enhanced.

In the above-described construction of the sheet feeding device, the sheet pressing element 23 biased by the plate spring 24 rotates to a position where it protrudes forward in the sheet feeding direction, as illustrated in FIGS. 5B and 7A, by actuation of the switching device 25 and the switch operation unit 34. In addition, the end fence main body 21 is fixed by engaging the meshing teeth portion 22*a* with the meshing teeth portion 30 as illustrated in FIG. 10B. On the other hand, when the switching device 25 is switched to the non-biasing condition by operation of the switch operation unit 34, the sheet pressing element 23 does not protrude forward in the sheet feeding direction (i.e., the sheet pressing element 23 retracts into the end fence main body 21) as illustrated in FIGS. 5A and 6A. In addition, the meshing teeth portion 22*a* is disengaged from the meshing teeth portion 30, thereby making the end fence main body 21 slidable along the sheet feeding direction as illustrated in FIG. 10A.

An operation for loading the sheets (S) into the cassette main body 15 is performed as follows. First, the bias force switching device 25 is switched to the non-biasing condition by the switch operation unit 34. Then, the end fence main body 21 is slid to a position where it does not interfere with the sheet loading operation, permitting the loading of sheets (S) into the cassette main body 15. The leading edge portion of the loaded sheets (S) in the sheet feeding direction is brought into contact with and aligned by the sheet leading edge regulating part 18. Subsequently, the end fence main body 21 is slid forward in the sheet feeding direction (i.e., toward the sheet leading edge regulating part 18) and abutted against the trailing edge portion of the sheets (S) in the cassette main body 15.

At this point, because the bias force of the plate spring 24 is not exerted on the sheet pressing element 23, the sheet pressing element 23 does not protrude forward in the sheet feeding direction and does not abut against the trailing edge portion of the sheets (S). Therefore, the problem of a slide stop position of the end fence main body 21 deviating from an adequate stop position due to the contact of the protruded sheet pressing element 23 with the trailing edge portion of the sheets (S) can be prevented. Further, the end fence main body 21 can be properly slid to an adequate stop position closest to the trailing edge portion of the sheets (S). Even when a sheet of an irregular size is used, the end fence main body 21 can still be properly slid to an adequate stop position.

Figure 11A:
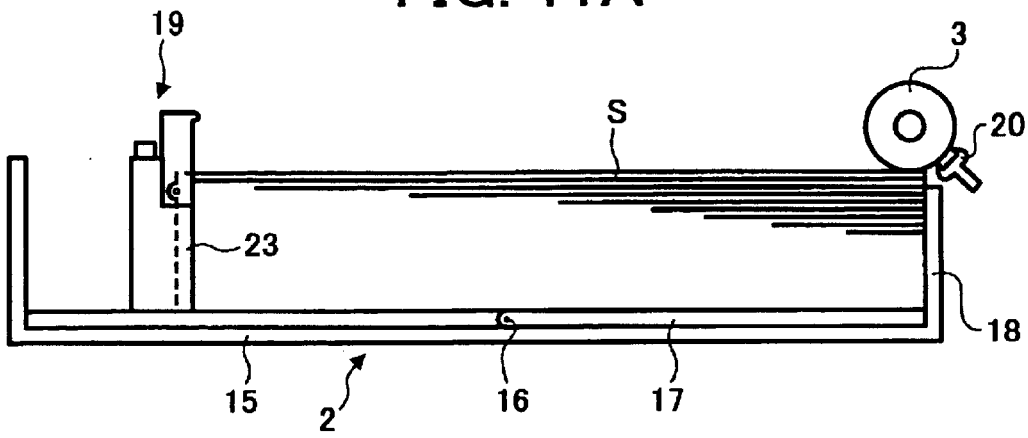
FIG. 11A is a side view of the sheet feeding device of FIG. 5A in which a large number of sheets contact the sheet pressing element and regulate a rotation of the sheet pressing element.

After the end fence main body 21 is slid to the adequate stop position, the switching device 25 is switched to the biasing condition by the switch operation unit 34. As a result, a bias force of the plate spring 24 is exerted on the sheet pressing element 23, and the end fence main body 21 is fixed as illustrated in FIG. 11A. Although the sheet pressing element 23 is biased forward in the sheet feeding direction by the plate spring 24, because a large number of sheets (S) contact the sheet pressing element 23 and regulate the rotation of the sheet pressing element 23, the position of the sheet pressing element 23 is substantially the same as that of the sheet pressing element 23 illustrated in FIG. 5A.

Figure 11B:
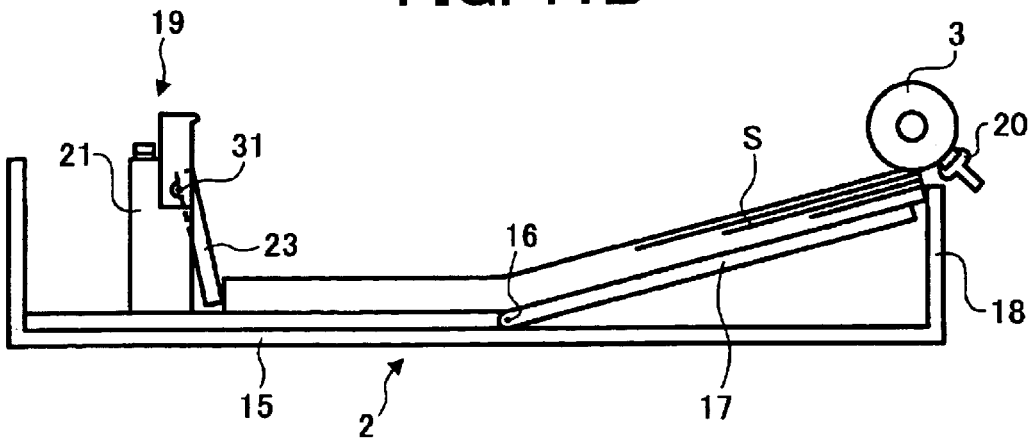
FIG. 11B is a side view of the sheet feeding device of FIG. 11A in which a bottom plate is rotated upward and the sheet pressing element presses the sheets forward in the sheet feeding direction.

After the sheets (S) are accommodated in the cassette main body 15, the sheets (S) are fed one by one to the imaging device by the sheet feeding roller 3. As the number of sheets (S) in the cassette main body 15 decreases as the image forming operation is repeated, the bottom plate 17 is rotated upward to make the uppermost sheet (S) contact the outer peripheral surface of the sheet feeding roller 3. Further, the sheet pressing element 23 biased by the plate spring 24 is rotated forward in the sheet feeding direction, thereby pressing the sheets (S) toward the sheet leading edge regulating part 18 (as illustrated in FIG. 11B) and substantially biasing the sheets (S) on the bottom plate 17 toward the sheet feeding direction. Even when the amount of the sheets (S) in the cassette main body 15 decreases and the bottom plate 17 is rotated upward, the contact condition between the sheet feeding roller 3 and the uppermost sheet (S) is properly maintained. Thus, all the sheets (S) in the cassette main body 15 can be stably fed from the sheet feeding cassette 2.

In the above-described embodiment, the plate spring 24 is integrally formed with the sheet pressing element 23. In this case, a smaller number of construction parts are used, thus decreasing the cost of the sheet feeding device. However, the plate spring 24 may be formed independently from the sheet pressing element 23 being secured thereto by, for example, a screw.

Further, the respective switch operations of the switching device 25 and the fixing device 22 are linked with each other by the link device 26. Alternatively, these switching operations may be performed independently from each other without the need to provide a link device.

Figure 12:
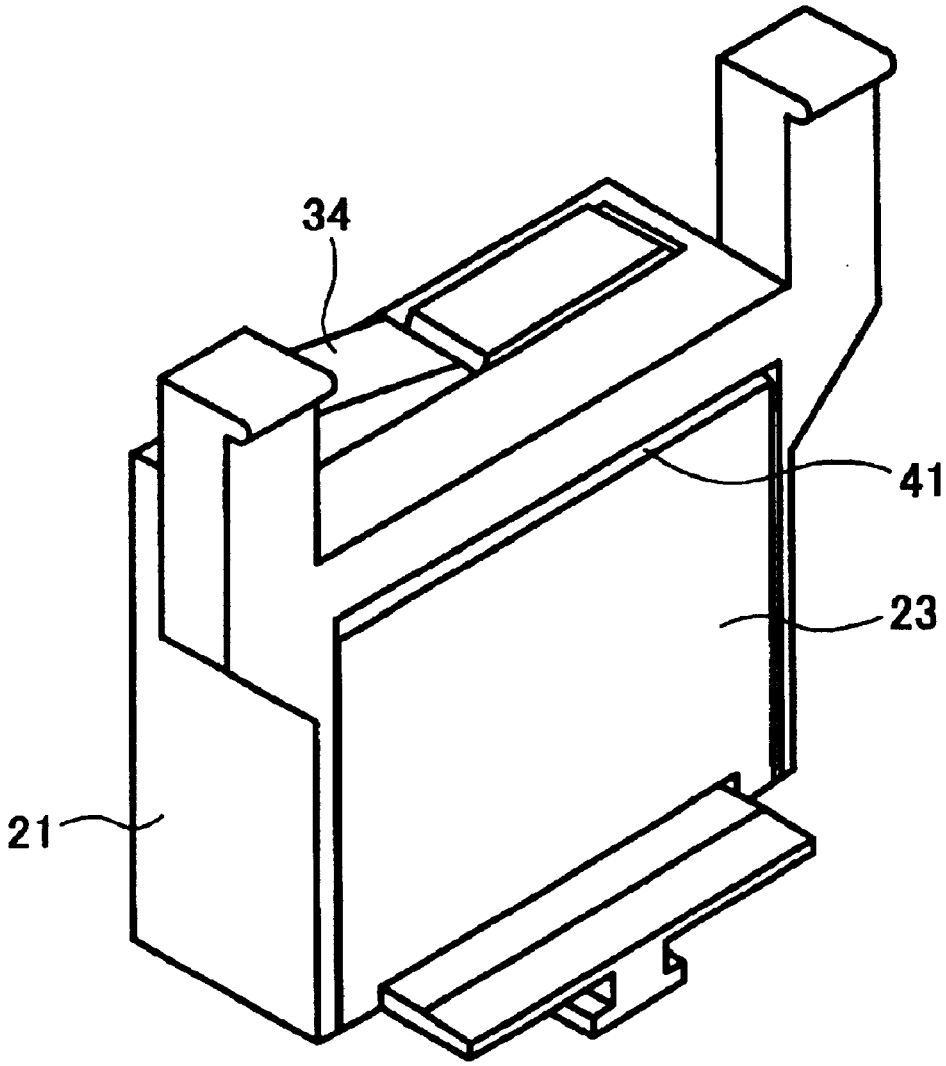
FIG. 12 is a perspective view of an end fence according to an alternative embodiment of the present invention.

Next, an end fence according to an alternative embodiment of the present invention will be described referring to FIG. 12. In this alternative embodiment, the sheet pressing element 23 is integrally formed with the end fence main body 21. A flexible portion 41 is formed at a connection part between the sheet pressing element 23 and the end fence main body 21, generally reducing component thicknesses. The sheet pressing element 23 is rotatable about the flexible portion 41 along the sheet feeding direction. In this construction, in which the sheet pressing element 23 is integrally formed with the end fence main body 21, a smaller number of construction parts are used, thus decreasing the cost of the sheet feeding device.

Next, a sheet feeding device according to another embodiment will be described referring to FIGS. 13A through 14D. An end fence 42 includes the end fence main body 21, the fixing device 22, the sheet pressing element 23, a coil spring 43 functioning as a biasing device, a bias force switching device 44, a link device 45, and a coil spring 46 functioning as an automatic returning device.

One end of the coil spring 43 is fixed onto the inner side surface of the end fence main body 21 and the other is attached onto the outer peripheral portion of a support shaft 47, which extends toward the sheet pressing element 23. The sheet pressing element 23 is biased it rotates forward in the sheet feeding direction by abutting one end of the coil spring 43 against its inner side surface. The coil spring 43 can maintain a preferable bias force over a relatively long period of time.

The bias force switching device 44 is configured to switch between a biasing condition and a non-biasing condition. In the biasing condition, the bias force of the coil spring 43 is exerted on the sheet pressing element 23 as illustrated in FIGS. 13A through 13D. In the non-biasing condition, no bias force is exerted as illustrated in FIGS. 14A through 14D. The bias force switching device 44 includes a switch operation unit 48, configured to switch the device 44 between the biasing and the non-biasing condition, and a movable element 49. Element 49 moves the coil spring 43 between the biasing position (as illustrated in FIG. 13D), where the the coil spring 43 exerts a force on the sheet pressing element 23, and a non-biasing position (as illustrated in FIG. 14D), where no force is exerted. The switch operation unit 48 is rotatably provided around the support shaft 47 such that it covers a part of the outer peripheral portion of the coil spring 43. The movable element 49 is integrally formed with the switch operation unit 48 and is positioned such that it contacts a cam portion 50 fixed at the inner side surface of the sheet pressing element 23.

The coil spring 46 functions as an automatic returning device that automatically returns the bias force switching device 44 to the biasing condition from the non-biasing condition. One end of the coil spring 46 is connected to the end fence main body 21, and the other is connected to the movable element 49.

When the movable element 49 moves to a non-biasing position by the switch operation unit 48, the contact position of the movable element 49 with respect to the cam portion 50 changes as illustrated in FIG. 14D, and the sheet pressing element 23 is rotated to a position where it does not protrude forward in the sheet feeding direction (i.e., the sheet pressing element 23 is retracted into the end fence main body 21). In this condition, the coil spring 46 is extended and exerts a force on the bias force switching device 44, making the bias force switching device 44 to automatically return to the biasing position.

A pin 51 is fixed to an upper end portion of the sliding element 22*a* of the fixing device 22, and is slidably engaged with an arc-shaped long hole 52 formed in the switch operation unit 48.

Figure 13A:
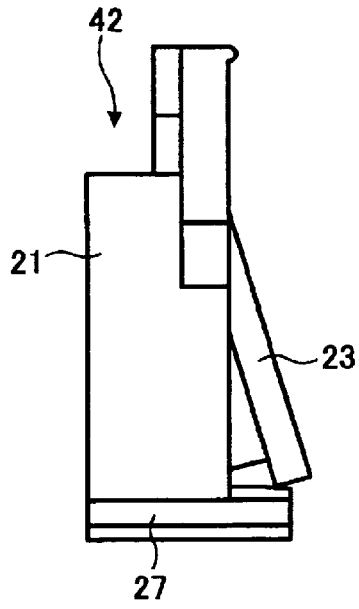
FIG. 13A is a side view of an end fence according to another embodiment of the present invention in which a bias force switching device is switched to a biasing condition.
Figure 13B:
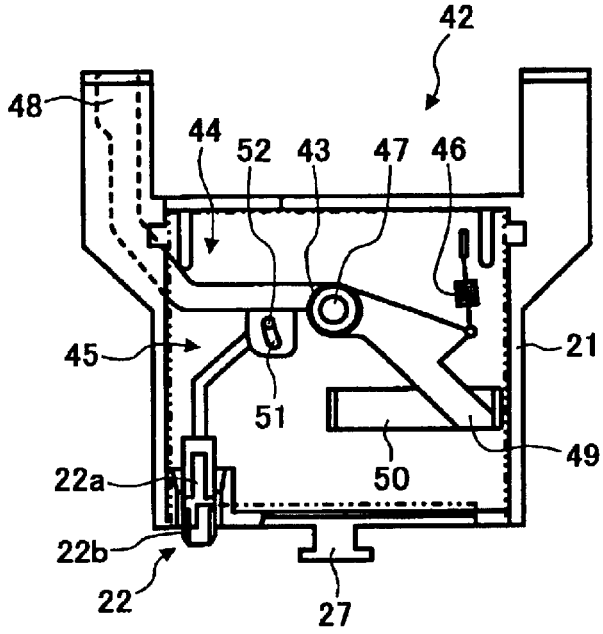
FIG. 13B is a front view of the end fence of FIG. 13A.
Figure 13C:
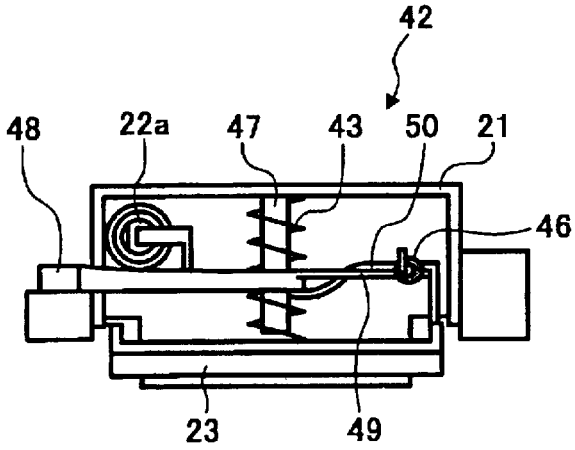
FIG. 13C is a plan view showing an inner construction of the end fence of FIG. 13A.
Figure 13D:
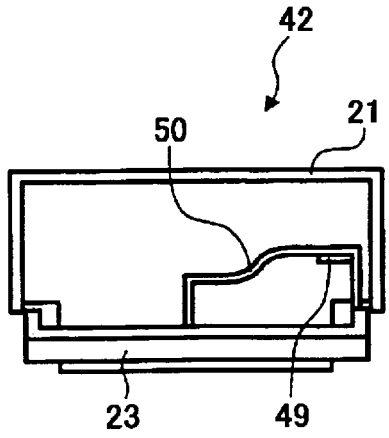
FIG. 13D is a plan view showing a part of the inner construction of the end fence of FIG. 13A.

When the bias force switching device 44 is switched to the biasing position, the pin 51 contacts the upper end side edge portion of the long hole 52 and is pressed downward, thereby sliding the sliding element 22*a* to a position where the sliding element 22*a* protrudes downward from the end fence main body 21 as illustrated in FIG. 13B. The end fence main body 21 is fixed by engaging the meshing teeth portion 22*b* of the sliding element 22*a* with the meshing teeth portion 30 of the fixing groove 29 as in the case of the sheet feeding device illustrated in FIG. 10B.

Figure 14A:
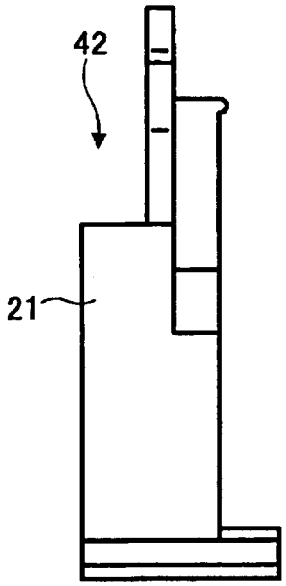
FIG. 14A is a side view of the end fence in which the bias force switching device is switched to a non-biasing condition.
Figure 14B:
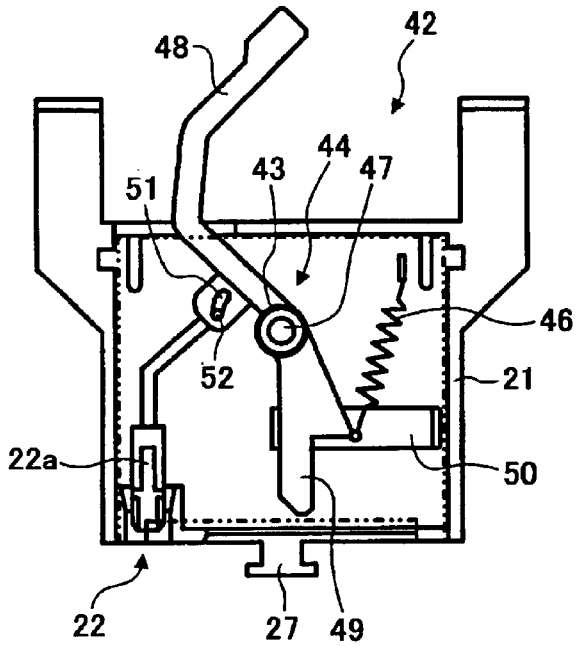
FIG. 14B is a front view of the end fence of FIG. 14A.
Figure 14C:
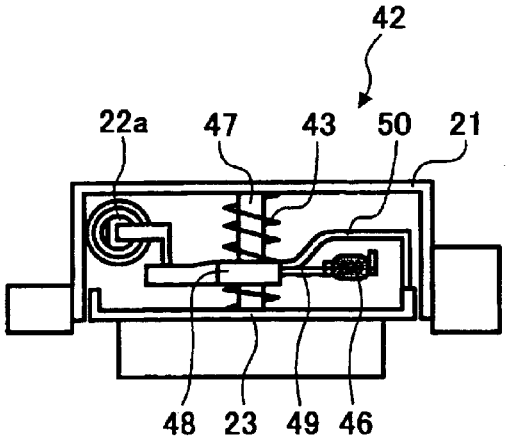
FIG. 14C is a plan view showing an inner construction of the end fence of FIG. 14A.
Figure 14D:
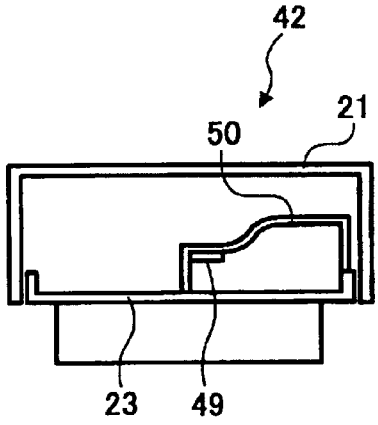
FIG. 14D is a plan view showing a part of the inner construction of the end fence of FIG. 14A.

When the switching device 44 is switched to the non-biasing position, the pin 51 contacts the lower end side edge portion of the long hole 52, and is pressed upward, thereby sliding the sliding element 22*a* upward from the lower end surface of the end fence main body 21 as illustrated in FIG. 14B, and disengaging the meshing teeth portion 22*b* of the sliding element 22*a* from the meshing teeth portion 30 of the fixing groove 29 as illustrated in FIG. 10A. As a result, the end fence main body 21 is released, becoming slidable along the sheet feeding direction.

The link device 45 is constructed such that pin 51 fixed at the upper end portion of the sliding element 22*a* is slidably engaged with the long hole 52 formed in the switch operation unit 48. With such a link device 45, the switching to the biasing condition by the switching device 44 is performed substantially simultaneously with the fixing of the end fence main body 21 by the fixing device 22. Likewise, the switching to the non-biasing condition by the switching device 44 is linked with the releasing of the end fence main body 21 by the fixing device 22 in a similar fashion. Thus, the operability of the end fence 42 is enhanced.

In the above-described construction of the sheet feeding device, the contact position of the movable element 49 with respect to the cam portion 50 changes by switching the switching device 44 to the non-biasing condition while operating the switch operation unit 48. Further, the sheet pressing element 23 is rotated to a position so as not to protrude forward in the sheet feeding direction as illustrated in FIGS. 14A through 14D. Moreover, the meshing teeth portions 22*a* and 30 are disengaged from each other, thereby permitting the end fence main body 21 to slide in the sheet feeding direction as illustrated in FIG. 10A. When the switch operation unit 48 is changed, the bias force switching device 44 automatically returns to the biasing condition by the bias force of the coil spring 46 (see FIGS. 13A through 13D). Further, the end fence main body 21 is fixed by engaging the meshing teeth portion 22*a* with the meshing teeth portion 30 as illustrated in FIG. 10B.

An operation for loading the sheets (S) into the cassette main body 15 is performed as follows. First, the bias force switching device 44 is switched to the non-biasing condition by the switch operation unit 48. Then, the end fence main body 21 is slid to a position where it does not interfere with the sheet loading operation, permitting the loading of the sheets (S) into the cassette main body 15. When sliding the end fence main body 21, the switch operation unit 48 needs to be pressed, keeping the force switching device 44 in the non-biasing condition. When the switch operation unit 48 is released, the switching device 44 automatically returns to the biasing condition, thus fixing the end fence main body 21. Then, the leading edge portion of the loaded sheets (S) in the sheet feeding direction is brought into contact with and aligned by the sheet leading edge regulating part 18. Subsequently, the bias force switching device 44 is switched to the non-biasing condition again, making the end fence main body 21 slidable. Subsequently, the end fence main body 21 is slid forward in the sheet feeding direction is abutted against the trailing edge portion of the sheets (S) in the cassette main body 15.

At this time, because coil spring 43 exerts no force on the sheet pressing element 23, the sheet pressing element 23 does not protrude forward in the sheet feeding direction and does not abut against the trailing edge portion of the sheets (S). Therefore, the problem of a slide stop position of the end fence main body 21 deviating from an adequate stop position due to the contact of the protruded sheet pressing element 23 with the trailing edge portion of the sheets (S) can be prevented. Further, the end fence main body 21 can be properly slid to an adequate stop position closest to the trailing edge portion of the sheets (S). Even when a sheet of an irregular size is used, the end fence main body 21 can still be properly slid to an adequate stop position.

After the end fence main body 21 is slid to the adequate stop position, the switching device 44 automatically returns to the biasing condition by releasing the switch operation unit 48. As a result, a bias force of the coil spring 43 is exerted on the sheet pressing element 23, fixing the end fence main body 21 while the sliding element 22*a* protrudes downward from the lower surface portion of the end fence main body 21 as illustrated in FIG. 13B.

After the sheets (S) are accommodated in the cassette main body 15, the sheets (S) are fed one by one to the imaging device by the sheet feeding roller 3. As the number of sheets (S) in the cassette main body 15 decreases as the image forming operation is repeated, the bottom plate 17 is rotated upward to make the uppermost sheet (S) contact the outer peripheral surface of the sheet feeding roller 3. Further, the sheet pressing element 23 biased by the coil spring 43 is rotated forward in the sheet feeding direction, thereby pressing the sheets (S) toward the sheet leading edge regulating part 18 (as illustrated in FIG. 11B) and substantially biasing the sheets (S) on the bottom plate 17 toward sheet feeding direction. Even when the amount of the sheets (S) in the cassette main body 15 decreases and the bottom plate 17 is rotated upward, the contact condition between the sheet feeding roller 3 and the uppermost sheet (S) is properly maintained. Thus, all the sheets (S) in the cassette main body 15 can be stably fed from the sheet feeding cassette 2.

In this embodiment, after the switching device 44 is switched to the non-biasing condition and the end fence main body 21 is slid, the switching device 44 automatically returns to the biasing condition by the coil spring 46. With this configuration, an error operation, such as, forgetting to return the switching device 44 to the biasing condition after sliding the end fence main body 21 can be prevented. Thus, a sheet feeding failure caused by such an operational error can be prevented.

Next, a sheet feeding device according to another embodiment will be described referring to FIGS. 15A and 15B. An end fence 54 includes the end fence main body 21, a fixing device (not shown), the sheet pressing element 23, a plate spring 55 functioning as a biasing device, and a pressing element 56 functioning as a bias force switching device.

The plate spring 55 is positioned at the end fence main body 21 so as to rotate about a support shaft 57. The plate spring 55 is positioned such that one of its ends abuts against the inner side surface of the sheet pressing element 23 when the plate spring 55 is rotated to a predetermined position.

The pressing element 56 is provided to the end fence main body 21 so as to rotate about a support shaft 58. The pressing element 56 causes the plate spring 55 to move to a biasing position (as illustrated in FIG. 15B) by exerting a force on the sheet pressing element 23 when the cassette main body 15 is pushed to a predetermined position in the main body case 1 of the printer of FIG. 4. Further, the pressing element 56 causes the plate spring 55 to move to a non-biasing position (as illustrated in FIG. 15A) when no force is exerted on the sheet pressing element 23 when the cassette main body 15 is pulled out of the main body case 1 to a predetermined position.

The pressing element 56 causes the sheet pressing element 23 to move to the biasing position by the following operations. When the cassette main body 15 is pushed to a predetermined position in the main body case 1, a bottom surface 59 of the main body case 1 contacts and rotates the pressing element 56 about the support shaft 58 in a direction indicated by arrow (a) in FIG. 15B. Subsequently, the leading edge portion of the rotated pressing element 56 presses and rotates the plate spring 55 in a direction indicated by arrow (b) in FIG. 15B. Then, one end of the plate spring 55 presses against the inner side surface of the sheet pressing element 23, causing it to rotate in a direction indicated by arrow (c) in FIG. 15B to the biasing position.

The pressing element 56 causes the sheet pressing element 23 to move to the non-biasing position by the following operations. When the cassette main body 15 is pulled out of the main body case 1 to a predetermined position, the bottom surface 59 of the main body case 1 is away from the pressing element 56, thereby rotating the pressing element 56 about the support shaft 58 in a direction indicated by arrow (d) in FIG. 15A by its own weight. While the pressing element 56 rotates in a direction indicated by the arrow (d), the sheet pressing element 23 rotates in a direction indicated arrow (e) in FIG. 15A to the non-biasing position while pressing the plate spring 55.

Figure 15A:
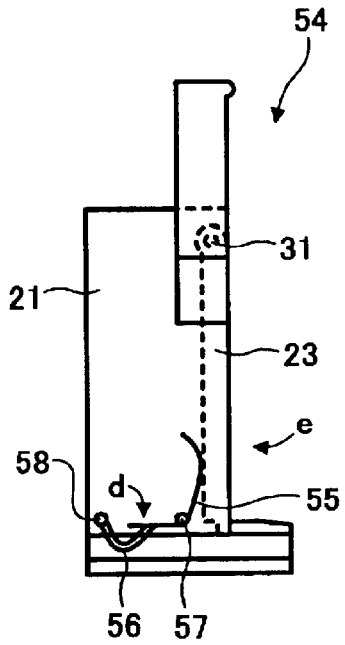
FIG. 15A is a side view of an end fence according to another embodiment of the present invention in which a bias force of a biasing device is not exerted on a sheet pressing element.
Figure 15B:
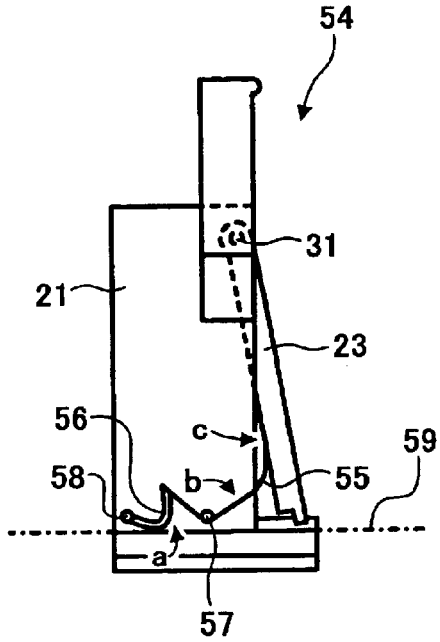
FIG. 15B is a side view of the end fence in which the bias force of the biasing device is exerted on the sheet pressing element.

In the above-described construction, when the cassette main body 15 is pulled out of the main body case 1 to a predetermined position, the bias force of the plate spring 55 is not exerted on the sheet pressing element 23 as illustrated in FIG. 15A. In this condition, after the sheets (S) are loaded into the cassette main body 15, the end fence main body 21 is released by the fixing device, and slid and abutted against the trailing edge portion of the sheets (S) in the cassette main body 15.

At this point, because the plate spring 55 does not exert a force on the sheet pressing element 23, it does not protrude forward in the sheet feeding direction and does not abut against the trailing edge portion of the sheets (S). Therefore, the problem of a slide stop position of the end fence main body 21 deviating from an adequate stop position due to the contact of the protruded sheet pressing element 23 with the trailing edge portion of the sheets (S) can be prevented. Further, the end fence main body 21 can be properly slid to an adequate stop position closest to the trailing edge portion of the sheets (S). Even when a sheet of an irregular size is used, the end fence main body 21 can still be properly slid to an adequate stop position.

After the end fence main body 21 is slid to the adequate stop position, the end fence main body 21 is fixed by the fixing device, and the cassette main body 15 is pushed into the main body case 1 to a predetermined position. By pushing the cassette main body 15 into the main body case 1, the sheet pressing element 23 is biased forward in the sheet feeding direction by the plate spring 55 as illustrated in FIG. 15B.

In this embodiment, the pressing element 56, the plate spring 55, and the sheet pressing element 23 function as an automatic switching device that automatically switches the plate spring 55 to either exert its bias force on the sheet pressing element 23 by pushing the cassette main body 15 into the main body case 1 to a predetermined position or not the cassette main body 15 is pulled out of the main body case 1 to a predetermined position. With such an automatic switching device, an operator loading the sheets (S) into the cassette main body 15 is not required to perform consciously the switching operation. Therefore, the switching operation for the pressing element 56 is never missed.

Figure 16A:
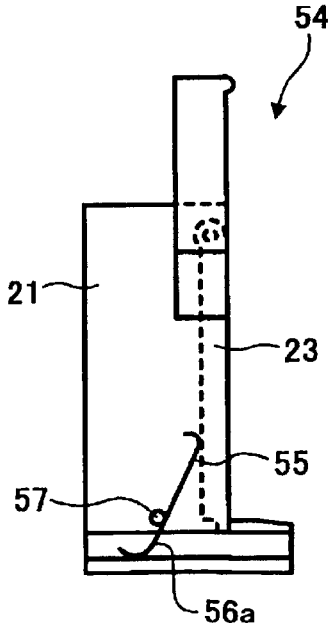
FIG. 16A is a side view of an end fence according to an alternative embodiment in which a bias force of a biasing device is not exerted on a sheet pressing element.
Figure 16B:
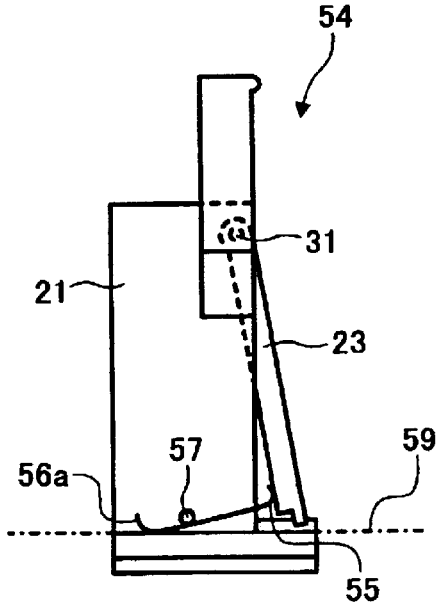
FIG. 16B is a side view of the end fence in which the bias force of the biasing device is exerted on the sheet pressing element.

In this embodiment, the pressing element 56 and the plate spring 55 are formed independently. However, as illustrated in FIGS. 16A and 16B, a pressing element 56*a* may be integrally formed with the plate spring 55 as a part of the plate spring 55. In this case, when the cassette main body 15 is pushed into the main body case 1 to a predetermined position, the bottom surface 59 of the main body case 1 contacts the pressing element 56*a*, and then the spring plate 55 biases the sheet pressing element 23 forward in the sheet feeding direction as illustrated in FIG. 16B. On the other hand, when the cassette main body 15 is pulled out of the main body case 1 to a predetermine position, the bottom surface 59 is away from the pressing element 56*a*. As a result, the bias force of the plate spring 55 is not exerted on the sheet pressing element 23 as illustrated in FIG. 16A.

The present invention has been described with respect to the exemplary embodiments illustrated in the figures. However, the present invention is not limited to these embodiments and may be practiced otherwise.

In the above-described embodiments, a sheet is used as a non-limiting example of a recording medium. The recording medium is not limited to a sheet but may be any sheet-shaped material.

Numerous additional modifications and variations of the present invention are possible in light of the above teachings. It is therefore understood that within the scope of the appended claims, the present invention may be practiced other than as specifically described herein.

What is claimed:

1. A fence for use in a sheet feeding cassette, comprising:

a fence main body movably attached to the sheet feeding cassette;

a sheet pressing element protruding from the fence main body, the sheet pressing element being movable and configured to press against trailing edges of sheets;

a biasing device configured to bias the sheet pressing element; and a bias force switching device configured to switch between a first condition in which a bias force of the biasing device is exerted on the sheet pressing element and a second condition in which the bias force of the biasing device is not exerted on the sheet pressing element.

2. The fence according to claim 1, wherein the bias force switching device comprises:

a switch operation unit configured to switch between the first and second conditions; and a movable element configured to move the biasing device in accordance with a switching operation.

3. The fence according to claim 1, further comprising:

an automatic returning device configured to automatically return the bias force switching device to the first condition from the second condition.

4. The fence according to claim 1, wherein the bias force switching device is configured to switch the biasing device to exert the bias force by pushing the sheet feeding cassette into a first predetermined position, and to switch the biasing device not to exert the bias force by pulling out the sheet feeding cassette to a second predetermined position.

5. The fence according to claim 1, further comprising:

a fixing device configured to fix the fence main body at any desired position in the sheet feeding cassette.

6. The fence according to claim 5, further comprising:

a link device configured to substantially simultaneously link switching to the first condition with fixing of the fence main body and to substantially simultaneously link switching to second condition with unfixing of the fence main body.

7. The fence according to claim 1, wherein the sheet pressing element is attached to the fence main body.

8. The fence according to claim 1, wherein the sheet pressing element is integrally formed with the fence main body.

9. The fence according to claim 1, wherein the biasing device comprises a plate spring configured to exert a bias force on the sheet pressing element.

10. The fence according to claim 9, wherein the plate spring is integrally formed with the sheet pressing element.

11. The fence according to claim 9, wherein the plate spring is attached to the fence main body.

12. The fence according to claim 1, wherein the biasing device comprises a coil spring configured to exert a bias force on the sheet pressing element.

13. A sheet feeding cassette, comprising:

a cassette main body configured to accommodate sheets;

a bottom plate that is provided at a bottom surface part of the cassette main body and is rotatable up and down while being biased upward; and the fence according to claims 1 through 12.

14. A sheet feeding device, comprising:

the sheet feeding cassette of claim 13; and a sheet feeding member configured to feed the sheets accommodated in the cassette main body one by one.

15. An image forming apparatus, comprising:

the sheet feeding device of claim 14; and an image forming device configured to form an image on the sheet fed by the sheet feeding device.

16. A fence for use in a sheet feeding cassette, comprising:

a fence main body movably attached to the sheet feeding cassette;

sheet pressing means for pressing against trailing edges of sheets;

biasing means for biasing the sheet pressing means; and bias force switching means for switching between a first condition in which a bias force of the biasing means is exerted on the sheet pressing means and a second condition in which the bias force of the biasing means is not exerted on the sheet pressing means.

17. The fence according to claim 16, further comprising:

a switch operation unit operated for switching between the first and second conditions; and movable means for moving the biasing means in accordance with a switching operation at the switch operation unit to a biasing position, where the bias force of the biasing means is exerted on the sheet pressing means, and to a non-biasing position, where the bias force of the biasing means is not exerted on the sheet pressing means.

18. The fence according to claim 16, further comprising:

automatic returning means for automatically returning the bias force switching means to the first condition from the second condition.

19. The fence according to claim 16, further comprising:

fixing means for fixing the fence main body at any desired position in the sheet feeding cassette.

20. The fence according to claim 19, further comprising:

linking means for linking switching to the first condition with fixing of the fence main body by the fixing means and for linking switching to the second condition with unfixing of the fence main body by the fixing means.

* * * * *